US006699058B1

(12) United States Patent
Estrela et al.

(10) Patent No.: US 6,699,058 B1
(45) Date of Patent: Mar. 2, 2004

(54) POWER PLUG ADAPTER ASSEMBLY AND METHOD

(75) Inventors: Peter Estrela, Fall River, MA (US); William C. Helton, Groton, CT (US); Timothy A. Adams, Voluntown, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/326,960

(22) Filed: Dec. 23, 2002

(51) Int. Cl.[7] ..... H01R 13/625
(52) U.S. Cl. ..... 439/346; 439/371
(58) Field of Search ..... 439/346, 265, 439/102, 106, 105, 349, 953, 651, 371

(56) References Cited

U.S. PATENT DOCUMENTS 3,358,265 A * 12/1967 Robards
3,890,025 A * 6/1975 Gray
4,111,509 A * 9/1978 Novak
4,544,216 A * 10/1985 Imhoff
5,194,013 A * 3/1993 Propp
5,249,976 A * 10/1993 Brock
5,573,420 A * 11/1996 Grosswendt ..... 439/371
5,603,628 A * 2/1997 Schapiro, Jr. ..... 439/371
5,766,032 A * 6/1998 LaPointe et al. ..... 439/371
5,785,547 A * 7/1998 Cross et al. ..... 439/371
6,080,002 A * 6/2000 Macleod et al. ..... 439/346
6,171,129 B1 * 1/2001 Phillips ..... 439/346
6,416,362 B1 * 7/2002 Conrad et al. ..... 439/346

* cited by examiner

*Primary Examiner*—Gary Paumen
(74) *Attorney, Agent, or Firm*—James M. Kasischke; Michael F. Olgo; Jean-Paul A. Nasser

(57) ABSTRACT

An assembly is provided for retaining standard electrical plugs within receptacles in environments having vibration and shock conditions that loosen normal electrical plugs. The present invention includes an adapter with a first locking mechanism for locking the adapter to the electrical receptacle. The adapter contains a standard electrical receptacle to receive the power plug prongs of the power plug. In a preferred embodiment, a restraining collar is mounted adjacent the power plug and secured to the adapter with tie straps to thereby secure the power plug to the adapter.

9 Claims, 3 Drawing Sheets

12
40
38
30
36
26
18
34
32
42
64
28
20
66
2C

POWER PLUG ADAPTER ASSEMBLY AND METHOD

STATEMENT OF THE GOVERNMENT INTEREST

The invention described herein may be manufactured and used by or for the Government of the United States of America for Governmental purposes without the payment of any royalties thereon or therefore.

BACKGROUND OF THE INVENTION (1) Field of the Invention

The present invention relates generally to power connections and, more particularly, to a power plug adapter and method to maintain a secure power connection in the presence of shock and vibration.

(2) Description of the Prior Art

Commercial off the shelf (COTS) electrical and electronic equipment are becoming more prevalent in Naval shipboard applications due to the cost benefits associated therewith. COTS units are normally supplied with National Electrical Manufacturer's Association (NEMA) 5-15P, three conductor power plugs, which in turn are inserted into commercial quality NEMA 5-15R power receptacles in convenience outlets, power strips, or uninterruptible power supplies. The mated commercial quality plugs and receptacles rely on the friction between the blades of the plug and the receptor devices in the outlet to hold the plug in the receptacle, even under conditions of vibration and shock. The friction fit in commercial quality plugs and receptacles provides an unreliable, inconsistent degree of restraint, and the fit degrades with repeated use. Thus, the COTS grade power plug/receptacle configuration is susceptible to unintentional power interruption caused by dislodging the plug from the receptacle under many shipboard conditions including inadvertent disconnection while cleaning or performing maintenance, mild to severe shock, and shipboard vibration conditions.

The COTS grade NEMA power plug/receptacle configuration is contrary to that found in previous shipboard Military Specifications and/or Ship Specifications. These specifications require power to be supplied via hard-wired methods or Military Specification connectors which positively secure the associated power plugs to the receptacles by mating threaded connections.

The inadvertent loss of power to equipment in response to shock could cause system reliability problems. Also, due to the high reliability of the existing hard wired and Military Specification connectors, in the event of an unexpected shut down of COTS equipment under normal and/or casualty conditions, and due to the typically difficult to reach NEMA 5-15 style power plug connections, the power conditions may not be initially checked before performing more invasive equipment troubleshooting, resulting in less efficient troubleshooting. U.S. Patents that describe attempts to provide solutions related to this problem include the following:

U.S. Pat. No. 3,358,265, issued Dec. 12, 1967, to P. O. Robards, discloses contact pins for a power control receptacle that are each provided with a hairpin spring in a contact barrel and a tab extending from a tab holder at one end.

U.S. Pat. No. 3,890,025, issued Jun. 17, 1975, to Gene L. Gray, discloses a standard, grounded three-conductor male electrical plug made to positively lock in place in its complementary female socket by friction pressure by means of a single tapered cam member which is connected to the plug body in such a way as to move longitudinally and to rotate within the split, scored ground connector of the male plug.

U.S. Pat. No. 4,111,509, issued Sep. 5, 1978, to John Novak, discloses a plug for an electrical receptacle outlet having an improved ground prong. The ground prong is supported in the plug body for axial shifting. The end of the prong extending through the plug body is threaded to engage a turn knob and the other end of the ground prong extending from the plug body for insertion in the receptacle is adapted to carry spring filaments which are supported to radially arch by the axial movement of the ground prong in response to the rotation of the knob and thereby secure the plug connected to the receptacle.

U.S. Pat. No. 4,544,216, issued Oct. 1, 1985, to R. W. Imhoff, discloses a three-prong plug including two active prongs and a grounding prong with an additional locking member which is recessed into the grounding prong. The grounding prong on the male portion of the plug has a V-shaped or U-shaped cross-section with the two sides of the electrical prong coming together with a ramp configuration at the outer end of the prong. An elongated locking member is mounted for longitudinal movement within the cross-sectional configuration of the grounding prong, with the outer end of the locking member engaging the ramp when the locking member reaches its extreme outer position to force the locking member transversely out of the recess within the U-shaped or V-shaped configuration of the third prong and into engagement with a portion of the mating female prong. In addition, arrangements are provided for normally biasing the locking member toward the outer end of the grounding prong; and release arrangements are secured to the male plug and in engagement with the locking member for unlocking the locking member and concurrently by moving the release member in a single direction for pulling the two plugs apart.

U.S. Pat. No. 5,194,013, issued Mar. 16, 1993, to Morris Propp, discloses a locking electrical plug which has a cooperating tool/key which when rotated in a first direction causes a ground prong extending therefrom to be mechanically expand within a mating female receptacle, thereby preventing inadvertent or accidental removal of the plug from the receptacle, and when rotated in a second direction this again permits the removal of the plug from the receptacle.

U.S. Pat. No. 5,249,976, issued Oct. 5, 1993, to R. D. Brock, discloses an electrical plug for 3-wire line cords that includes a plug body having a U-shaped grounding pin. A rise pin is disposed between opposing walls of the U-shaped grounding pin. A locking element extending through the plug body includes a threaded proximal portion and a flat distal portion, the distal portion having a ramp disposed over the rise pin and a serrate edge opposite the ramp with the distal portion disposed within the grounding pin opposing walls. A locking knob is threaded onto the proximal portion. With the plug in an outlet, the knob is rotated clockwise to draw the flat distal portion rearward causing the ramp to ride up the rise pin and to cause the serrate edge to grip the inner surfaces of the grounding socket. Rotating the knob counterclockwise releases the serrate edge to permit withdrawal of the plug from the outlet.

U.S. Pat. No. 6,171,129, issued Jan. 9, 2001, to D. A. Phillips, discloses an electrical adapter with dual, user-operable locking mechanisms for attachment to a standard electrical plug and outlet, one for securing the prongs of the adapter into a socket or wall-mounted outlet or receptacle and the other for securing a standard electrical plug thereto. The two mechanisms work independently of each other to secure the male and female sides of a conventional plug-and-socket combination together. The adapter can be used with existing appliances, hand tools, extension cords, and electrical outlets without the need for rewiring. The male and female ends of the adapter may be connected by an electrical cord to replace a conventional extension cord; alternatively, the locking mechanism can be built into replacement electrical plugs or a wall outlet having approximately the same dimensions as conventional outlets. Use eliminates the annoying problem of power interruptions to appliances, hand tools, and the like that occur when a plug is accidentally pulled loose from its socket. The invention also provides extra safety from electrocution and reduces spark hazards by locking the plug and socket together to help prevent accidental dislodging.

The above cited prior art does not provide a means for adapting commonly utilized NEMA power plugs normally found on COTS equipment to provide a highly reliable vibration and shock resistant power connection. Consequently, there remains a long felt but unsolved need for an improved means for connecting NEMA power plugs in a more consistently reliable manner. Those skilled in the art will appreciate the present invention that addresses the above and other problems.

SUMMARY OF THE INVENTION

Accordingly, it is an object of the present invention to provide an improved power plug and receptacle assembly and method.

Another object of the present invention is to provide a more reliable connection between a COTS power plug and corresponding power receptacle.

Another object is to provide an assembly and method as aforesaid which does not require modification or replacement of the numerous NEMA power plugs and NEMA receptacles found on COTS equipment.

These and other objects, features, and advantages of the present invention will become apparent from the drawings, the descriptions given herein, and the appended claims. However, it will be understood that above listed objects and advantages of the invention are intended only as an aid in understanding aspects of the invention, are not intended to limit the invention in any way, and do not form a comprehensive list of objects, features, and advantages.

In accordance with the present invention, an assembly is provided for use with a power plug and power plug receptacle wherein the power plug is secured to a power plug cable. The assembly may comprise one or more elements such as, for instance, an adapter with power prong connections wherein the power prong connections mate to the power plug receptacle and the adapter has an adapter receptacle operable for mating engagement with the power plug such that the adapter is operable to electrically connect the power plug to the power plug receptacle. Other elements may comprise a first locking mechanism for securing the adapter to the power plug receptacle and a second locking mechanism for securing the adapter to the power plug.

In a presently preferred embodiment, the first locking mechanism may further comprise an expandable element. The expandable element may be mounted within at least one of the power prong connections such that after the power prong connections are inserted into the power plug receptacle the expandable element is expanded to lock the adapter to the power plug receptacle.

In a presently preferred embodiment, the second locking mechanism may further comprise a restraining member mountable with respect to the power plug for securing the power plug with respect to the adapter. The restraining member may comprise split components to thereby mount onto the power plug cable. The split components are securable together such that the restraining member is secured around the power plug cable. The assembly may further comprise one or more straps interconnectable between the restraining member and the adapter to thereby secure the power plug to the adapter.

In operation, a method is provided that may be utilized for securing a NEMA power plug to a NEMA power plug receptacle to resist vibration and shock without modifying the NEMA power plug or the NEMA power plug receptacle. The method may comprise one or more steps such as, for instance, inserting an adapter into the NEMA power plug receptacle, securing the adapter to the NEMA power plug receptacle, inserting the NEMA power plug into the adapter, and/or securing the NEMA power plug to the adapter.

The method may further comprise expanding an expandable portion of at least one prong of the adapter after the adapter is inserted into the NEMA power plug receptacle and/or providing the expandable portion is comprised of an electrometric material. The method may further comprise utilizing a threaded member to apply tension to the expandable portion.

The method may further comprise mounting a restraining member to the cable adjacent the NEMA power plug and/or connecting one or more straps between the restraining member and the adapter. In a preferred embodiment, the method may further comprise utilizing split elements to form the restraining member to the cable and/or utilizing one or more straps to secure the split elements together around the cable.

The method may further comprise providing at least one first loop on the adapter and at least one second loop on the restraining member and/or inserting one or more flexible straps into the first loop and the second loop.

In another embodiment, the invention comprises an assembly with one or more elements such as an adapter with power prong connections wherein the power prong connections mate to the power plug receptacle and the adapter has at least one adapter receptacle operable for mating engagement with at least one power plug, and a first locking mechanism for securing the adapter to the power plug receptacle. The first locking mechanism further comprises an expandable element mounted within at least one of the power prong connections such that after the power prong connections are inserted into the power plug receptacle and the expandable element is expandable to lock the adapter to the power plug receptacle. The assembly may comprise an axially moveable tensioner such that the tensioner is moveable against the expandable element to urge the expandable element to expand radially outwardly.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout several views of the drawings and wherein.

BRIEF DESCRIPTION OF THE PREFERRED EMBODIMENTS

While the present invention is discussed in terms of a specific embodiment that may be used to provide more reliable power connection, other embodiments could also be utilized. For instance, in commercial applications, adapters from one socket to many sockets are sometimes utilized which tend to have insufficient tension in the one socket to hold the entire assembly to the socket, especially after multiple plugs have been inserted. Features of the present invention may be utilized to provide improved adapters. Other embodiments of the present invention are also possible.

Figure 1:
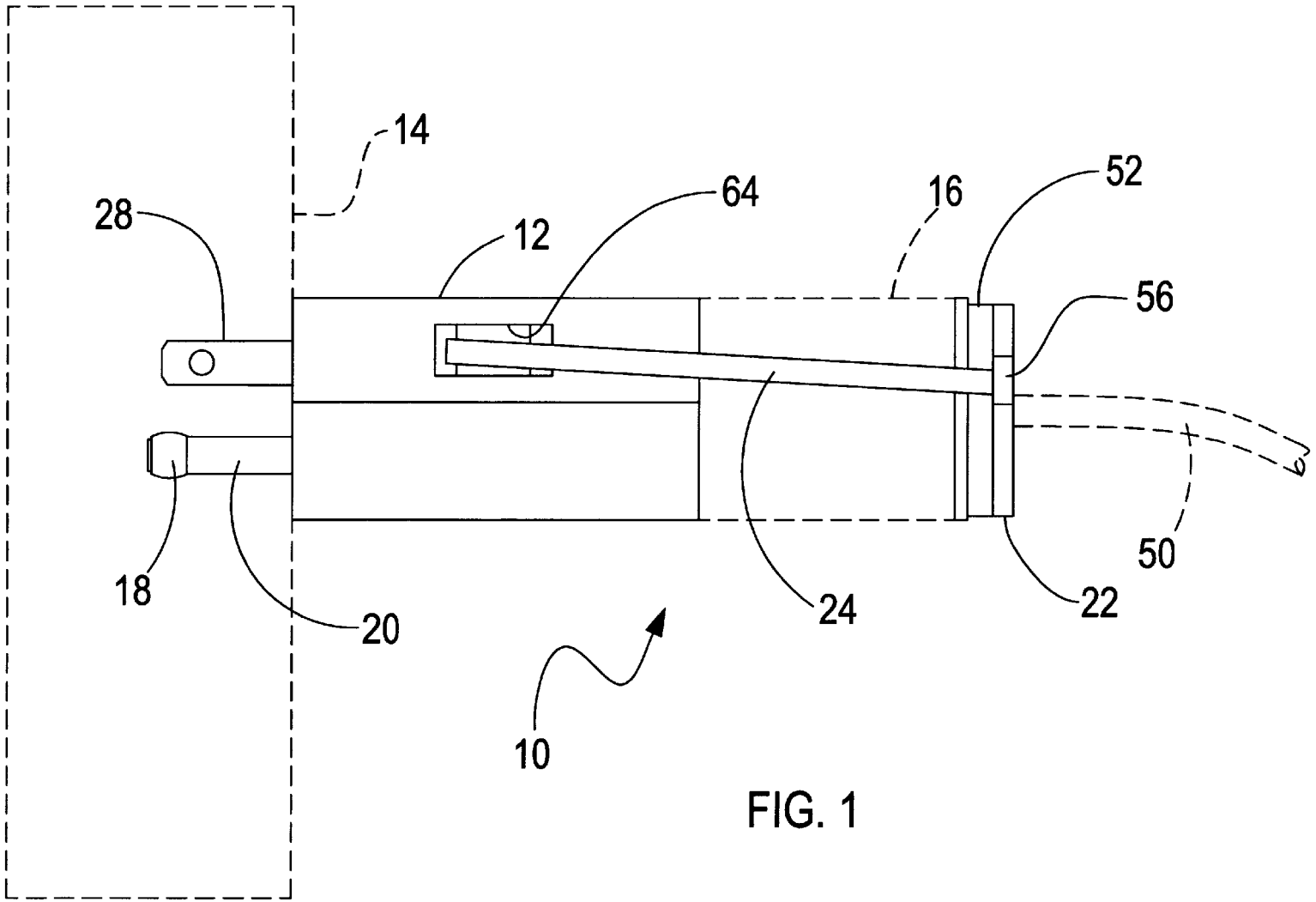
FIG. 1 is an elevational view, partially in hidden lines, which shows an assembly including a power plug adapter for securing a NEMA power plug to a NEMA socket in accord with the present invention.

Referring now to the drawings and, more specifically to FIG. 1, there is shown an adapter assembly 10 in accord with the present invention. In this FIG., prior art objects are indicated with dashed lines. Adapter assembly 10 utilizes adapter 12 that may be locked to a power plug socket, such as a NEMA power plug socket 14. Adapter 12 also includes power receptacles that are the same as those of NEMA power plug socket 14 for receiving an existing power plug 16, which is preferably a NEMA power plug. Adapter 12 has two standard power prongs 26 and 28 and a modified ground prong 20, as will be discussed in the following text.

Adapter assembly 10 further comprises first and second locking assemblies for securing the assembly together to thereby effectively secure power plug 16 to power plug receptacle or socket 14. In a preferred embodiment, adapter assembly 10 requires no changes to standard NEMA power plugs and sockets. It will be understood that many different types of locking assemblies may be utilized.

In overview of FIG. 1, the first locking assembly is utilized to lock adapter 12 to power socket 14. In a preferred embodiment, an expandable portion 18 is utilized on ground prong 20 to secure adapter 12 to power socket 14. Further details of operation of the first locking assembly are discussed hereinafter.

The second locking assembly is utilized to lock adapter 12 to the existing power plug 16. A restraining collar 22 is securely mounted on an opposite side of power plug 16 from adapter 12. Then straps 24, which may include the readily available nylon tie straps, are utilized to secure restraining collar 22 to adapter 12 via strap slots 64 and 66 in the adapter 12 and strap mounts 56 and 58 in the collar 22. Thus, assembly 10 results in power connection with greatly increased resistance to shock and vibration.

Figures 2A, 2B, 2C:
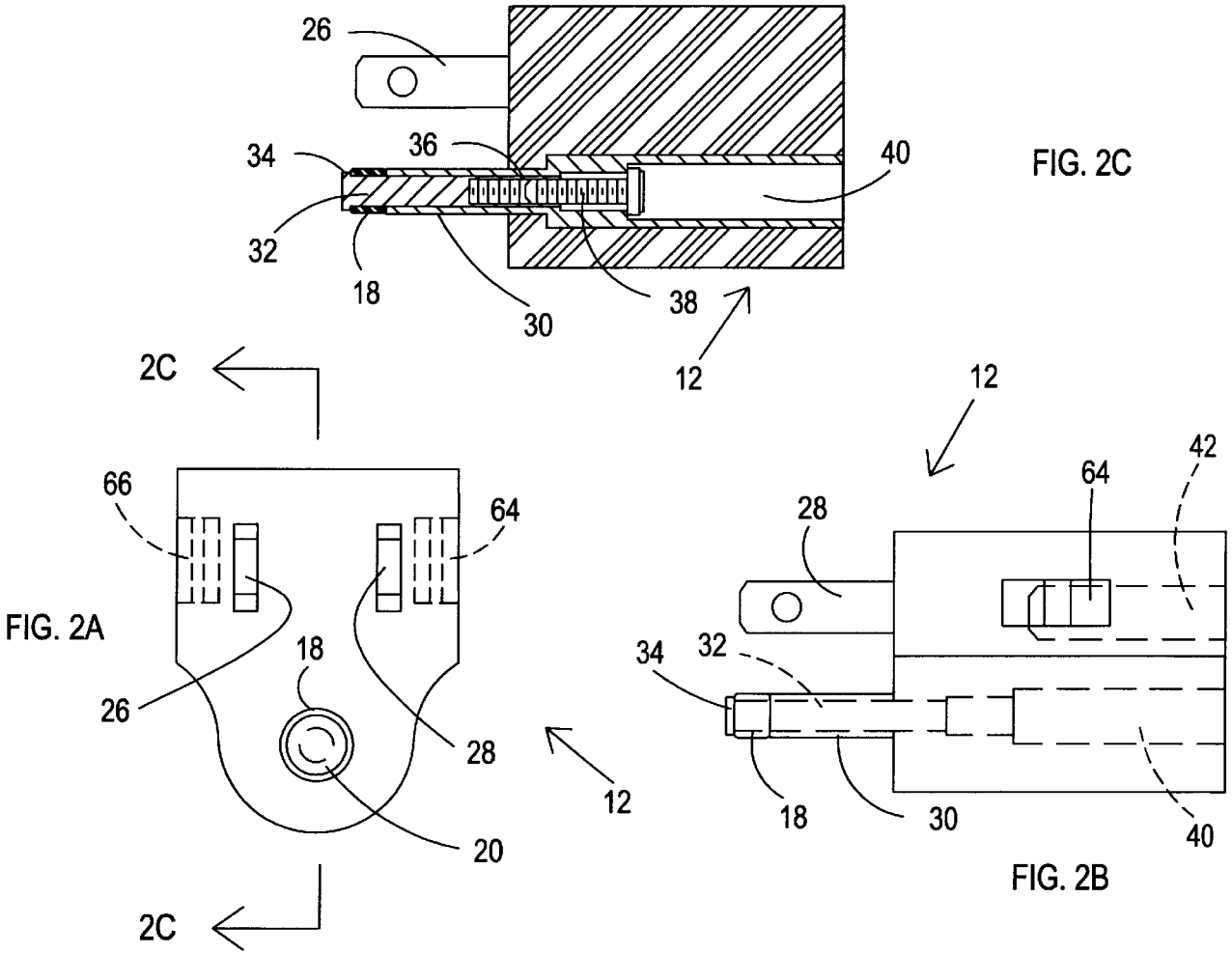
FIG. 2A is an elevational end view, partially in hidden lines, of an adapter in accord with the present invention.
FIG. 2B is an elevational side view, partially in hidden lines, of an adapter in accord with the present invention.
FIG. 2C is a sectional side view of an adapter along lines 2C—2C in FIG. 2A in accord with the present invention.

FIG. 2A, FIG. 2B, and FIG. 2C show a detailed construction of a presently preferred adapter 12 in accord with the present invention. FIG. 2C is a sectional view taken along lines 2C—2C of the end view of FIG. 2A. In this case, as compared to FIG. 1, expandable portion 18 is shown in a relaxed position. Expandable portion 18 may be made of any suitable material, which when compressed, will expand radially outwardly. Suitable materials may include elastomeric materials. Preferably, elastic materials are utilized so that the expandable material will more easily move radially inwardly to release when the compression is removed. However, if a permanent connection is desired, then this is not necessary.

Due to the typically somewhat larger size and cylindrical shape of ground prong 20, the ground prong is a presently preferred location for the expandable member. However, other types of expandable members might be utilized with the other power blades or prongs 26 and 28. Electrical tubular connection portion 30, of ground prong 20, is preferably formed of conductive metal to provide the desired electrical connection. Likewise, power prongs 26 and 28 are preferably formed of metal to produce the desired electrical connection. A tensioner element 32 is slidably mounted within ground prong 20 for movement within tubular connection portion 30. Tensioner element 32 includes compression cap 34 which is utilized to engage and compress expandable portion 18. In this embodiment, tensioner element 32 includes a threaded socket portion 36 to receive tensioning screw 38. Tensioning screw 38 may be conveniently operated through aperture 40 into which a screwdriver may be inserted. Thus, tensioning screw 38 may be rotated to tighten tensioner element 32 and compression cap 34 to compress and radially expand expandable portion 18. Expandable portion 18 preferably should be made from a material supporting high elastic strain so that it will retract when tensioning screw 38 is loosened. In this way, adapter 12 is anchored to power plug socket 14. Aperture 40 may also serve as the corresponding ground receptacle to receive the ground prong of power plug 16. Tensioning screw 38 and tensioner element 32 may conveniently provide the electrical connection between the ground prong of power plug 16 and ground prong 30 of adapter 12. Thus, adapter 12 has similar sockets, which may preferably be the same as those found in standard NEMA power receptacles, such as sockets 40 and 42 as shown in FIG. 2B, for making electrical connection with and receiving the power prongs from power plug 16. Adapter 12 also has strap mounts 64 and 66 which will be discussed in the following text.

Figure 3A:
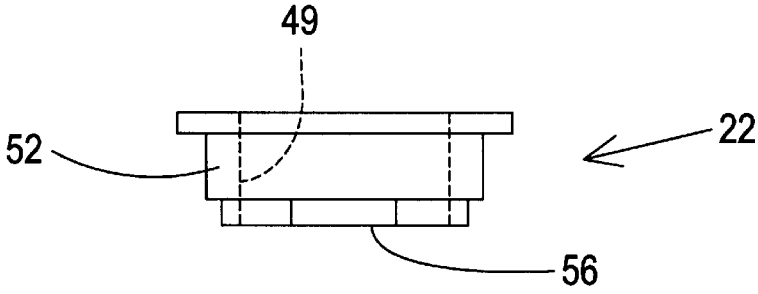
FIG. 3A is an elevational top view, partially in hidden lines, of a restraining collar in accord with the present invention.
Figure 3B:
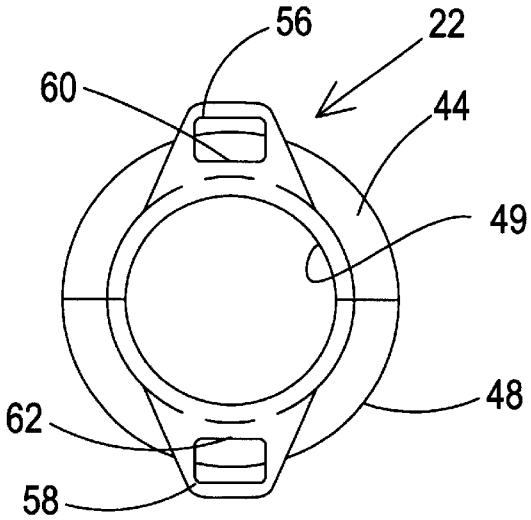
FIG. 3B is an elevational end view of the restraining collar of FIG. 3A.
Figure 3C:
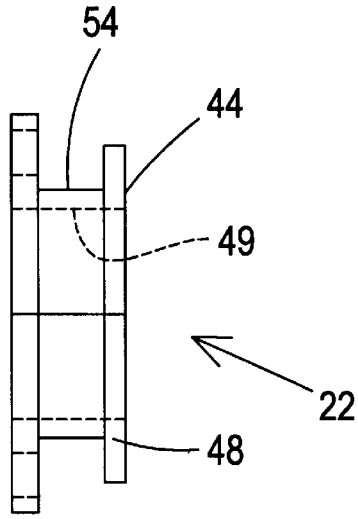
FIG. 3C is an elevational side view, partially in hidden lines, of the restraining collar of FIG. 3A.

While the above illustrates how to anchor or lock adapter 12 to power plug socket 14, it is also necessary to anchor or lock power plug 16 to adapter 12. While numerous methods and means are available to affect this purpose, in the presently preferred embodiment, restraining collar 22 is utilized. Several different views of restraining collar 22 are shown in FIG. 3A, FIG. 3B, and FIG. 3C. Restraining collar 22 is preferably formed in split sections such as half sections 44 and 48. Once sections 44 and 48 are joined together, a cord aperture 49 is defined at the center of collar 22. In this way, sections 44 and 48 can easily mount around the power cord, such as power cord 50 shown in FIG. 1. As shown in FIG. 1, restraining collar 22 is mounted on an opposite end of power plug 16 from adapter 12.

Half sections 44 and 48 may then be easily clamped together by such means as tie strap 52 shown in FIG. 1. Tie strap 52 may be positioned within groove 54 of restraining collar 22, which groove is shown most clearly in FIG. 3C. Tie straps are readily available and easily tightened to secure half sections 44 and 48 together, although other clamps, latches, and the like could be utilized for this purpose.

Restraining collar 22 preferably supports outwardly extending tie strap mounts 56 and 58 in which apertures 60 and 62 are formed. Likewise, adapter 12 has tie strap mounts 64 and 66 as indicated in FIG. 2A and FIG. 2B. Thus, in the present embodiment, two straps may be utilized and inserted into tie strap mounts 56 and 58 on restraining collar 22 and also tie strap mounts 64 and 66 on adapter 12, respectively. As the tie straps, such as tie strap 24 shown in FIG. 1, are tightened, power plug 16 is thereby secured to adapter 12.

Thus, in operation adapter 12 may be inserted into socket 14. After insertion, then tensioning screw 38 may be rotated to thereby expand expandable portion 18 as indicated in FIG. 1. NEMA power plug 16 can be inserted into the mating NEMA receptacles found in adapter 12. Split components 44 and 48 of restraining collar 22 are mounted to cable 50 and secured together by tie strap 52. Two tie straps may then be inserted into respective tie strap mounts found on adapter 12 and restraining collar 22 and tightened thereby securing assembly 10 together. The end result is a power connection assembly that resists vibration and shock without the need to modify or replace the standard NEMA plugs and sockets that come with COTS equipment. In this embodiment, the diameter of adapter 12 and restraining collar 22 is substantially the same as the diameter of the plug so that adjacent power plugs will not interfere with each other. However, the same principle could be utilized in larger diameter adapters that include multiple sockets for connecting multiple power cables to a single receptacle.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An assembly for use with a power plug and power plug receptacle, said power plug being secured to a power plug cable, said assembly comprising:

an adapter having power prong connections, said power prong connections operable for mating to the power plug receptacle, said adapter having an adapter receptacle operable for mating engagement with the power plug such that said adapter is operable to electrically connect the power plug to the power plug receptacle;

a first locking mechanism to secure said adapter to the power plug receptacle; and a second locking mechanism to secure said adapter to the power plug at least one strap joinable to said adapter; and a collar joinable to said at least one strap, said collar being mountable with respect to the power plug, and said collar, strap and adapter together capable of securing the power plug with respect to said adapter.

2. The assembly of claim 1 wherein said first locking mechanism comprises an expandable element mounted within at least one of said power prong connections such that after said power prong connections are inserted into the power plug receptacle said expandable element is selectively expandable to lock said adapter to the power plug receptacle.

3. The assembly of claim 2 wherein said collar comprises split components to thereby mount onto the power plug, said split components being securable together such that said collar is secured around the power plug.

4. An assembly for use with a power receptacle and a power plug having power prongs, a grounding prong and a power cable, said assembly comprising:

a housing having strap slots formed on an exterior thereof, a receptacle end with power prong receiving slots and a grounding prong receiving slot formed therein, and a mating end;

adapter prongs joined to said housing and extending from the mating end thereof, said adapter prongs each being in electrical contact with an associated one of said power prong receiving slots;

an adapter grounding prong joined to said housing and extending therefrom, said grounding prong being in electrical contact with said grounding prong receiving slot, and said grounding prong having a securing means to secure said grounding prong to the power receptacle;

a collar having a power cable aperture therein and strap mounts thereon positionable about one of the power cable and the power plug to retain the power plug in said housing; and straps joinable between said housing strap slots and said collar strap mounts to retain the power plug within said housing.

5. The assembly of claim 4 wherein said grounding plug securing means comprises an expandable portion located on said grounding prong and having an expanded position wherein said expandable portion is capable of interfering with the power receptacle and preventing removal of said housing and a contracted position allowing removal of said housing from the power receptacle.

6. The assembly of claim 5 wherein:

said grounding prong has an expansion cavity formed therein and a threaded tensioning aperture positioned at the end of said grounding prong toward said receptacle end of said housing; and said expandable portion comprises:

an expansion member positioned about the exterior of a portion of said grounding prong;

a compression cap positioned within said grounding prong proximate to said expansion member; and a tensioning screw threaded within said grounding prong tensioning aperture and rotatable from said receptacle end of said housing whereby rotation of said tensioning screw creates pressure on said compression cap resulting in expansion of said expansion member.

7. The assembly of claim 6 wherein said expansion member is made from a material supporting sufficient elastic strain to allow expansion and contraction of said expansion member.

8. The assembly of claim 4 wherein said collar is manufactured in two collar portions securable about one of the power plug and the power cable to retain the power plug in the housing.

9. The assembly of claim 6 further comprising a tie strap positionable about said two collar portions to secure said collar portions about one of the power plug and the power cable.

* * * * *